US009745814B2

(12) United States Patent
Layden et al.

(10) Patent No.: US 9,745,814 B2
(45) Date of Patent: Aug. 29, 2017

(54) SYSTEM AND METHOD FOR CASING MILLING

(75) Inventors: Reginald W. Layden, Calgary (CA); Gary Joseph Werner, Inglewood, CO (US)

(73) Assignee: Xtreme Drilling and Coil Services Corp., Houston, TX (US)

( * ) Notice: Subject to any disclaimer, the term of this patent is extended or adjusted under 35 U.S.C. 154(b) by 570 days.

(21) Appl. No.: 13/817,916

(22) PCT Filed: Sep. 2, 2011

(86) PCT No.: PCT/US2011/050304

§ 371 (c)(1),
(2), (4) Date: Apr. 16, 2013

(87) PCT Pub. No.: WO2012/031185

PCT Pub. Date: Mar. 8, 2012

(65) Prior Publication Data

US 2013/0213641 A1 Aug. 22, 2013

Related U.S. Application Data

(60) Provisional application No. 61/379,636, filed on Sep. 2, 2010.

(51) Int. Cl.
*E21B 44/02* (2006.01)
*E21B 29/06* (2006.01)

(52) U.S. Cl.
CPC ..... *E21B 29/06* (2013.01); *E21B 44/02* (2013.01)

(58) Field of Classification Search
CPC ..... E21B 45/00; E21B 19/22; E21B 47/00; E21B 29/06; E21B 44/02
See application file for complete search history.

(56) References Cited

U.S. PATENT DOCUMENTS

| | | | | |
|---|---|---|---|---|
| 5,234,053 | A * | 8/1993 | Connell | 166/250.01 |
| 6,321,596 | B1 * | 11/2001 | Newman | 73/152.45 |
| 2004/0065477 | A1 * | 4/2004 | Paulk et al. | 175/50 |
| 2004/0182574 | A1 * | 9/2004 | Adnan et al. | 166/250.01 |
| 2005/0115741 | A1 * | 6/2005 | Terry et al. | 175/61 |
| 2011/0024103 | A1 * | 2/2011 | Storm, Jr. | E21B 17/206 166/65.1 |

* cited by examiner

*Primary Examiner* — David Andrews
*Assistant Examiner* — Kristyn Hall
(74) *Attorney, Agent, or Firm* — Bushman Werner, P.C.

(57) ABSTRACT

A method and/or system is provided for milling an opening into a tubular positioned in a well bore using coiled tubing. Surface equipment includes a programmable controller at the surface, which is utilized for controlling an injector motor so that an encoder for monitoring movement of said coiled tubing string produces less than a predetermined maximum number of pulses for a given time interval.

10 Claims, 1 Drawing Sheet

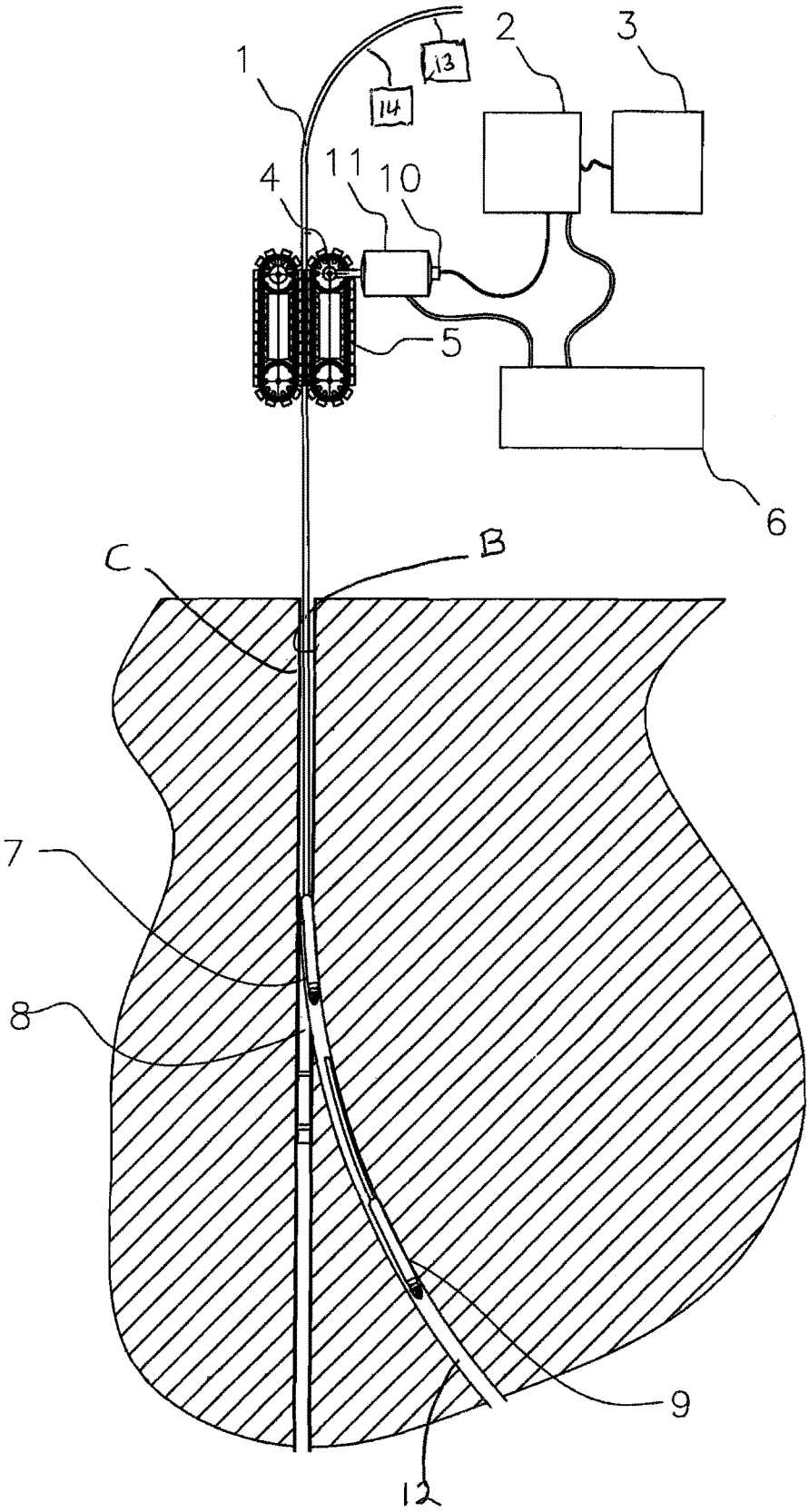
1
2
3
13
14
4
11
10
5
6
C
B
7
8
9
12

SYSTEM AND METHOD FOR CASING MILLING

CROSS REFERENCE TO RELATED APPLICATION

This application claims benefit of U.S. Provisional Application Ser. No. 61/379,636 filed on Sep. 2, 2010, the disclosure of which is incorporated herein by reference for all purposes.

FIELD OF THE INVENTION

The present invention relates to a method and apparatus for milling through wellbore casing.

BACKGROUND OF THE INVENTION

In order to optimize production from existing wells, it is often desirable to re-enter the wells and, after milling a window in the well casing, sidetrack the well into better reservoir rock. Further, directional drilling to provide multi-lateral well bores from an existing main bore hole has become increasingly popular in many formations.

In sidetracking and directional drilling of multi-lateral wells, coiled tubing offers many benefits, including faster mobilization and demobilization, faster trip times, continuous circulation during tripping, smaller footprint, less site preparation and remediation.

However, one of the limitations of using coiled tubing in casing milling is that the torque available at the bit, i.e., the milling tool, is limited to the output of the torque of a downhole motor. Thus, unlike techniques for casing milling using conventional wellbore drilling or servicing rigs, in the use of coiled tubing, because of torque limitations, the rate of penetration into the casing wall is more likely to stall than in use of conventional methods.

SUMMARY OF THE INVENTION

According to one aspect of the present invention, there is provided a system for casing milling.

In another aspect of the present invention there is provided a system for milling casing employing a coiled tubing injector.

Still another aspect of the present invention is to provide a method for milling a lateral opening or window or the like through casing in a well bore; e.g., an oil or gas well.

In one embodiment, the present invention provides a system for milling casing windows comprising a coiled tubing injector and a control/monitoring system operatively connected to the coiled tubing injector, the control/monitoring system, once set to the desired rate of penetration, controls the advance of the coiled tubing injector, such that a desired rate of penetration of a milling tool into the casing wall stays within a desired range.

In another embodiment, the present invention provides a system for milling casing window, comprising a coiled tubing injector, a programmable controller for calculating pulses generated by a depth encoder based on an inputted penetration rate; i.e., distance versus time, and an electric motor operatively connected to the coiled tubing injector and the programmable controller to rotate and advance the coiled tubing injector at the desired rate.

In another aspect of the present invention, there is provided a method for milling windows in casing in boreholes using the above-described system.

In yet additional embodiments, the present invention provides a method for milling an opening into a tubular positioned in a well bore with coiled tubing.

One method may comprise steps such as, for example only, utilizing a string of coiled tubing, utilizing a milling tool mounted on the string of coiled tubing, and utilizing an injector motor operable to control an injector for moving the string of coiled tubing into and out of the well bore.

In one possible embodiment, a method may comprise utilizing an encoder which produces pulses indicative of movement of the string of coiled tubing of coiled tubing into and out of the well bore.

Other steps may comprise utilizing a tension sensor for the coiled tubing for use in determining a weight on the milling tool during milling and/or utilizing a controller programmed for controlling the injector motor and providing that he controller is operably connected to the tension sensor, and the encoder. In one possible embodiment, the controller is programmed to control the injector motor so that the encoder produces less than a predetermined maximum number of pulses for a given time interval.

In another embodiment, the controller is programmed to control the injector motor to maintain the selected weight unless the encoder produces more than the predetermined maximum number of pulses for the given time period, e.g. reaches a limit, whereupon the controller operates the injector motor to limit movement of the coiled tubing into the well bore.

The controller may be programmed to operate the injector motor to stop movement of the coiled tubing for a remainder of the given time interval if the predetermined number of pulses is exceeded.

The methods may comprise utilizing the controller to calculate a weight on the milling tool based on the tension sensor, a depth of the milling tool, a weight of drilling fluid, and a weight of the coiled tubing.

The methods may comprise utilizing a drilling fluid sensor whereby the controller is further programmed to detect out of range values for at least one of drilling fluid flow rate and drilling fluid pressure which indicate a problem with the milling.

In another embodiment, a coiled tubing milling system is provided for use in milling an opening into a tubular positioned in a well bore. The system may comprise elements such as a string of coiled tubing, a milling tool mounted on the string of coiled tubing, and an injector motor operable to control an injector for moving the string of coiled tubing into and out of the well bore.

An encoder or other motion detector produces an electronic signal, which is indicative of movement of the string of coiled tubing of coiled tubing into and out of the well bore. A tension sensor may be used in determining a weight on the milling tool during milling.

A controller may in one embodiment be programmed for controlling the injector motor and is operably connected to the tension sensor and the encoder.

An interface can be used for inputting a selected weight on the milling tool and a maximum rate of movement of the string of coiled tubing. In one possible embodiment, the controller is programmed to maintain the selected weight on the milling tool within a desired range unless the maximum rate of movement of the string of coiled tubing is exceeded whereupon the controller operates the injector motor to limit movement of the coiled tubing into the well bore.

In one embodiment, the encoder produces a predetermined number of pulses for a given movement of the coiled tubing. Other detectors of movement may also be utilized in accord with the invention. The controller may be programmed to operate the injector motor to limit movement of the coiled tubing so that the encoder produces less than a predetermined number of pulses for a given time interval.

In one embodiment, the controller is programmed to operate the injector motor to stop movement of the coiled tubing for a remainder of the given time interval if the predetermined number of pulses is exceeded.

The system may further comprise a drilling fluid sensor whereby the controller is further programmed to detect out of range values for at least one of drilling fluid flow rate and drilling fluid pressure which indicate a problem with the milling.

In one embodiment, the controller is operable for calculating a weight on the milling tool based on the tension sensor, a depth of the milling tool, a weight of drilling fluid, and a weight of the coiled tubing.

BRIEF DESCRIPTION OF THE DRAWING

The single FIGURE is a schematic drawing of one embodiment of the present invention.

DETAILED DESCRIPTION OF PREFERRED EMBODIMENTS

Referring to the FIGURE, there is shown a formation F, having a vertical borehole B in which is disposed a string of casing C. Disposed in casing C is a whipstock 8, which as is well known to those skilled in the art, is commonly used to "kick-off" a milling tool used to form an opening in casing. Milling tool 7 (driven by a downhole motor not shown) is connected to a string of coiled tubing 1, which is alternatively inserted and withdrawn from casing C using coiled tubing injector 5.

Coiled tubing injector 5 is operatively connected to a depth encoder 4, which in turn is connected to a programmable logic controller (PLC) 2. Depth encoder 4 may comprise any electronic device which produces an electronic output for movement, speed, and so forth of the coiled tubing. PLC 2 may be a processor, computer, or other type of controller which may be programmed to control the milling operation as discussed herein. PLC 2 is connected to a human machine interface (HMI) 3 into which an operator inputs the desired rate of penetration of milling tool 7. Motor drive 6 is operatively connected to PLC 2, a motor encoder 10, and an electric motor 11.

In operation, an operator determines the desired rate of penetration and via the HMI 3, inputs the necessary data. Then in one embodiment, PLC 2 then calculates the number of pulses the depth encoder 4 will generate for this inputted rate. However, it will be understood that other devices for measuring movement rather than a particular depth encoder 4 are not limited to a particular type of depth encoder, depth measurement device, or a particular type of signal e.g. pulses, digitized depth data readings or files, sine waves, or other signals. Thus, the corresponding description will be interpreted accordingly for any particular embodiments discussed.

The PLC 2 via motor drive 6 signals the electric motor 11 to rotate and advance injector 5 at the desired rate, which in turn advances milling tool 7 at the desired rate.

It will be understood that in milling casing using coiled tubing, very slow rates of penetration; e.g., one foot per hour or less, are required to prevent the downhole motor driving milling tool 7 from stalling. Accordingly, encoder 4 may generate only a handful of pulses over the inputted time frame. In one embodiment, if PLC 2, monitoring the number of pulses generated by encoder 4, sees that the target number of pulses has been reached before the inputted time interval has lapsed, the PLC 2 stops the milling. Once the inputted interval has lapsed, the PLC 2 again commands motor 11 to rotate and advance the injector 5 at the desired rate. If the maximum number of pulses for the inputted rate is never exceeded, PLC 2 continuously advances the injector 5 at a desired rate and/or a rate, which may be dependent on weight on bit and/or other factors.

It is also desirable in milling casing with coiled tubing to monitor weight on bit; i.e., milling tool 7, and the drilling fluid pressure. To this end, differential pressure sensors and bit weight sensors are also employed. For example, coiled tubing tension sensor 13 and/or or other sensors may be utilized in conjunction with accumulated depth information from encoder 4 and/or controller 2, hole deviation information inputted through human interface 3, coiled tubing size and/or weight information, drilling fluid weight, and/or other information to determine an estimated weight on the bit. It will be appreciated by those of skill in the art that the weight on the bit is limited, especially when using coiled tubing, and will typically be considerably less than the weight of the coiled tubing in the hole, most of which will typically be in tension and only some of which will be in compression during operation for producing the weight on the bit or milling tool 7.

As well, the drilling fluid flow rates and/or drilling fluid pressure may utilize one or more sensors 14 to detect a range of drilling fluid flow and/or pressure to obtain information concerning operation of milling tool 7, which may preferably be hydraulically operated utilizing the flow of drilling fluid pressure whereby changes in drilling fluid flow and/or pressure may be utilized to provide a status of the functioning of milling tool 7.

Thus, in addition to monitoring the number of pulses, the PLC monitors differential pressure (which may also comprise drilling fluid flow rate and/or pressure information) and weight on bit. If either of these latter two parameters exceeds the value inputted by the operator, the PLC commands the motor drive 6 to adjust; e.g., slow down, until the value(s) is again within the range.

Accordingly, in one possible embodiment of the present invention, the operator may input a desired range of weight on bit and drilling fluid pressure and/or flow rate to interface 3. The operator may also input a maximum rate of penetration, which is measured with encoder 4. In this particular embodiment, the injector will be programmed to continue to allow additional tubing 1 into the wellbore so long as the weight on the bit and/or drilling fluid pressure and/or flow rate stay within the desired range. However, if the encoder detects too many pulses per a preset interval (which would indicate the maximum rate of penetration is too high), then PLC 2 will control injector 5 to stop and not allow additional movement of coiled tubing 1 into wellbore until the preset interval has transpired. Thus, the likelihood of a stalled mill and the problems with restarting and so forth are avoided.

In another embodiment, PLC 2 may be utilized to respond to out of range drilling fluid information by stopping movement of coiled tubing 1, and/or raising coiled tubing 1 by a desired amount and the waiting for restarting of the milling as indicated on the drilling fluid information and then lowering at a selected rate to the desired weight on bit at a desired speed to thereby automatically restart and continue milling.

It will be noted that in this particular embodiment, the weight on bit and/or drilling fluid information is prioritized by PLC 2 as the main controllers of movement of injector 5, which will move coiled tubing 1 as needed to maintain the weight on bit at the desired level. The rate of movement is then, in this particular embodiment, a secondary priority unless the maximum rate of penetration is surpassed whereby PLC 2 is programmed to then prevent further movement within a particular time interval or for a predetermined time period to thereby slow movement of the coiled tubing to the predetermined maximum rate.

The maximum rate of penetration may be predetermined based on testing and/or other data, size and type of pipe, size of the mill and mill motor specifications and the like. In this way, the desired rate of penetration, which the controller may be utilized to interpret as a desired number or encoder pulses per interval, can be predetermined for input by the operator.

In another embodiment, PLC 2 may be programmed to prioritize rate of penetration by operating injector 5 to move coiled tubing 1 at a predetermined rate whereby if the weight on bit and/or drilling fluid indicators stay within a preset range then the milling operation continues.

Turning again to the figure, there is also shown a bottom hole assembly 9 which, after the casing milling has been completed, is attached to the coiled tubing 1 and is used to drill a sidetrack wellbore 12.

A distinct advantage of the control/monitoring system of the present invention is that it serves as a backup to ensure greater penetration rate when what has inputted is in fact not experienced. Thus, one purpose of the system of the present invention is that it prevents excessive speed due to a potential surge in speed of the milling tool after a hang-up of the tool in the casing wall.

While the present invention has been described with respect to the milling of casing using coiled tubing, it will be understood that the control/monitoring system of the present invention could be used in casing milling using conventional wellbore drilling and servicing rigs.

What is claimed is:

1. A method for milling an opening into a tubular positioned in a well bore with coiled tubing, comprising:
- utilizing a string of coiled tubing;
- utilizing a milling tool mounted on said string of coiled tubing;
- utilizing an injector motor operable to control an injector for lowering and raising said string of coiled tubing into and out of said well bore;
- utilizing an encoder which produces pulses indicative of movement of said string of coiled tubing of coiled tubing into and out of said well bore;
- utilizing a tension sensor for said coiled tubing for use in determining a weight on said milling tool during milling; and
- utilizing a controller programmed for controlling said injector motor, said controller being operably connected to said tension sensor and said encoder, said controller being programmed to control said injector motor so that said encoder produces less than a predetermined maximum number of pulses for a given time interval, wherein said controller is programmed to control said injector motor to maintain said selected weight unless said encoder produces more than said predetermined maximum number of pulses for said given time period whereupon said controller operates said injector motor to limit or stop lowering of said coiled tubing into said well bore.

2. The method of claim 1, wherein said controller is programmed to operate said injector motor to stop lowering said coiled tubing for a remainder of said given time interval if said predetermined number of pulses is exceeded and to resume lowering said coiled tubing after said given time interval has lapsed.

3. The method of claim 1, wherein said controller is operable for calculating a weight on said milling tool based on said tension sensor, a depth of said milling tool, a weight of drilling fluid, and a weight of said coiled tubing.

4. The method of claim 1, further comprising utilizing a drilling fluid sensor whereby said controller is further programmed to detect out of range values for at least one of drilling fluid flow rate and drilling fluid pressure which indicate a problem with said milling, and wherein said controller is operable for controlling movement of said coiled tubing in response to said out of range values.

5. A coiled tubing milling system for use in milling an opening into a tubular positioned in a well bore, comprising:
- a string of coiled tubing;
- a milling tool mounted on said string of coiled tubing;
- an injector motor operable to control an injector for lowering and raising said string of coiled tubing into and out of said well bore;
- an encoder which produces an electronic signal indicative of movement of said string of coiled tubing of coiled tubing into and out of said well bore;
- a tension sensor for said coiled tubing for use in determining a weight on said milling tool during milling;
- a controller programmed for controlling said injector motor and being operably connected to said tension sensor and said encoder; and
- an interface for inputting a selected weight on said milling tool and a maximum rate of movement of said string of coiled tubing, whereby said controller is programmed to maintain said selected weight on said milling tool unless said maximum rate of movement of said string of coiled tubing is exceeded whereupon said controller operates said injector motor to limit or stop lowering of said coiled tubing into said well bore.

6. The system of claim 5, wherein said encoder produces a predetermined number of pulses for a given movement of said coiled tubing, said controller being programmed to operate said injector motor to limit lowering of said coiled tubing so that said encoder produces less than a predetermined number of pulses for a given time interval.

7. The system of claim 6, wherein said controller is programmed to operate said injector motor to stop lowering said coiled tubing for a remainder of said given time interval if said predetermined number of pulses is exceeded and to resume lowering said coiled tubing after said given time interval has lapsed.

8. The system of claim 5, further comprising a drilling fluid sensor whereby said controller is further programmed to detect out of range values for at least one of drilling fluid flow rate and drilling fluid pressure which indicate a problem with said milling.

9. The system of claim 5, wherein said controller is operable for calculating a weight on said milling tool based on said tension sensor, a depth of said milling tool, a weight of drilling fluid, and a weight of said coiled tubing.

10. A coiled tubing milling system for use in milling an opening into a tubular positioned in a well bore, comprising:
- a coiled tubing injector;
- a control/monitoring system operatively connected to said coiled tubing injector, said control/monitoring system, once set to a desired rate of penetration of a milling tool into said tubular, controls an advance of said coiled tubing injector to lower coiled tubing into said well bore, such that said desired rate of penetration stays within a desired range, said control/monitoring system comprising a programmable controller for monitoring pulses generated by a depth encoder whereby said programmable controller counts said pulses per a desired time period to monitor said desired rate of penetration;

an electric motor operatively connected to said coiled tubing injector and said programmable controller to rotate and advance said coiled tubing injector at said desired rate;

said programmable controller being programmed to operate said electric motor to stop lowering said coiled tubing for a remainder of said desired time period if said desired range of said rate of penetration is exceeded and to resume lowering said coiled tubing after said given time interval has lapsed.

* * * * *